US006622361B1

(12) United States Patent
Wilson

(10) Patent No.: US 6,622,361 B1
(45) Date of Patent: Sep. 23, 2003

(54) RAILROAD CLIP REMOVAL SYSTEM HAVING A PAIR OF ARMS WITHIN A GUIDE SLOT

(76) Inventor: Timothy R. Wilson, 1805-2nd Ave. North, Moorhead, MN (US) 56560

( * ) Notice: Subject to any disclaimer, the term of this patent is extended or adjusted under 35 U.S.C. 154(b) by 0 days.

(21) Appl. No.: 10/096,471

(22) Filed: Mar. 11, 2002

(51) Int. Cl.[7] ..... B23P 19/04

(52) U.S. Cl. ..... 29/229; 29/243.56; 104/13; 254/18

(58) Field of Search ..... 29/243.56, 252, 29/229, 426.6, 225; 104/13, 2, 17.2, 7.1; 254/28, 18, 22

(56) References Cited

U.S. PATENT DOCUMENTS 263,783 A * 9/1882 Hood ..... 254/99
1,516,155 A * 11/1924 Santarelli ..... 254/18
5,265,661 A * 11/1993 Tran ..... 157/1.3
5,628,102 A * 5/1997 Johnson ..... 29/225
6,113,073 A * 9/2000 Lefavour et al. ..... 254/18

* cited by examiner

*Primary Examiner*—S. Joseph Morano
*Assistant Examiner*—Frantz F. Jules
(74) *Attorney, Agent, or Firm*—Michael S. Neustel

(57) ABSTRACT

A railroad clip removal system for efficiently removing a fastening clip from a receiver bracket of a crosstie. The railroad clip removal system includes a frame structure having a center cutout and a pair of opposing slots, an actuator, a pair of engaging arms pivotally attached to the actuator and slidably positioned within the opposing slots. The engaging arms have a catch portion that engages the fastening slip while the engaging arms simultaneously compress the prongs of the fastening clip thereby removing the fastening clip from the receiver bracket of a crosstie.

19 Claims, 11 Drawing Sheets

FIG 12c
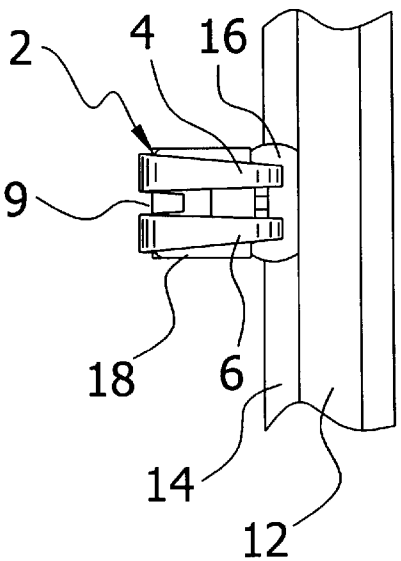
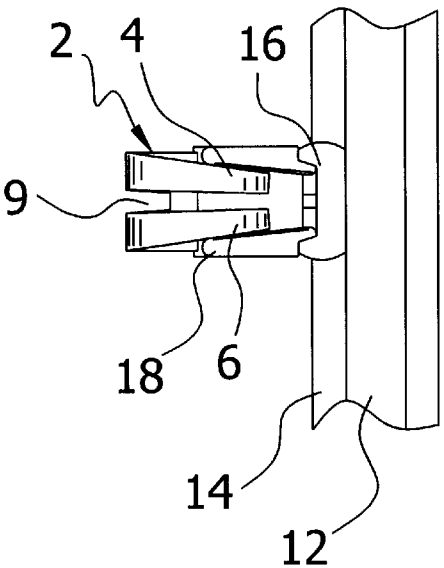
FIG 12b
FIG 12a
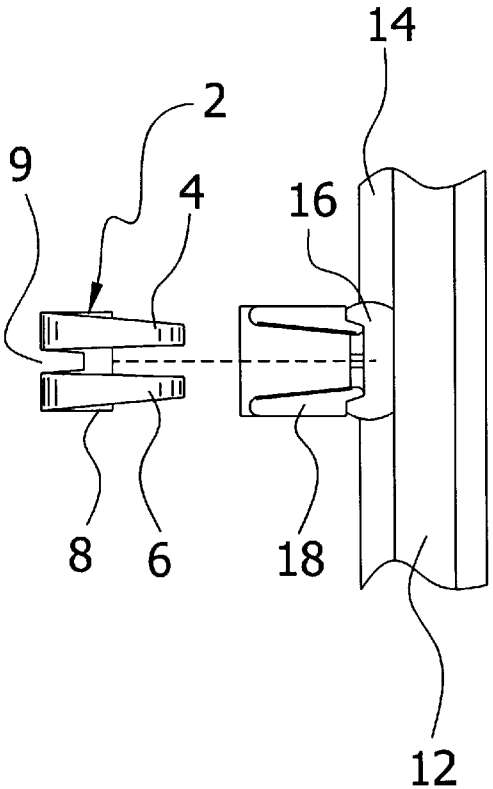

RAILROAD CLIP REMOVAL SYSTEM HAVING A PAIR OF ARMS WITHIN A GUIDE SLOT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to railroad clip removers and more specifically it relates to a railroad clip removal system for efficiently removing a fastening clip from a receiver bracket of a crosstie.

2. Description of the Prior Art

Crossties are an essential part of a railroad's structure. A crosstie is basically a transverse beam or rod serving as a support for the rails of a railroad. Crossties have conventionally been constructed of wood wherein a bracket structure is secured to each crosstie adjacent the rail with a spike driven into thereby securing the rail to the crosstie.

However, crossties are seeing heavier and more-frequent train wear than ever before. Wood, the perennial favorite, is seeing more competition from alternative materials, such as concrete, steel and plastic. Railroads are becoming more aware of alternative materials in their search to extend the life of their structures. Concrete crossties are the second most common form of crosstie after wooden crossties. Fastening clips are attached to a receiver bracket formed within or secured to the concrete adjacent to the rail thereby securing the rail in place upon the concrete crosstie. A common type of fastening clip is comprised of a C-shaped structure having a lower U-shaped portion curving upwardly and forwardly into a pair of parallel prongs with a rear slot between. To apply the fastening clip, the user must compress the sides of the prongs together and then insert into the receiver bracket and then release the prongs thereby locking the fastening clip within the receiver bracket and securing the rail to the receiver bracket. To remove the fastening clip, the user must compress the sides of the prongs together and then remove from the receiver bracket.

However, it can be a very time consuming and tedious task to compress the sides of the fastening clips and then remove the fastening clips from the bracket structures of the concrete crossties. Hence, there is a need for an efficient fastening clip removal system.

While these devices may be suitable for the particular purpose to which they address, they are not as suitable for efficiently removing a fastening clip from a receiver bracket of a crosstie. Conventional fastening clip removal systems are difficult to operate and require significant physical exertion.

In these respects, the railroad clip removal system according to the present invention substantially departs from the conventional concepts and designs of the prior art, and in so doing provides an apparatus primarily developed for the purpose of efficiently removing a fastening clip from a receiver bracket of a crosstie.

SUMMARY OF THE INVENTION

In view of the foregoing disadvantages inherent in the known types of fastening clip removal devices now present in the prior art, the present invention provides a new railroad clip removal system construction wherein the same can be utilized for efficiently removing a fastening clip from a receiver bracket of a crosstie.

The general purpose of the present invention, which will be described subsequently in greater detail, is to provide a new railroad clip removal system that has many of the advantages of the fastening clip removal devices mentioned heretofore and many novel features that result in a new railroad clip removal system which is not anticipated, rendered obvious, suggested, or even implied by any of the prior art fastening clip removal devices, either alone or in any combination thereof.

To attain this, the present invention generally comprises a frame structure having a center cutout and a pair of opposing slots, an actuator, a pair of engaging arms pivotally attached to the actuator and slidably positioned within the opposing slots. The engaging arms have a catch portion that engages the fastening slip while the engaging arms simultaneously compress the prongs of the fastening clip thereby removing the fastening clip from the receiver bracket of a crosstie.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a railroad clip removal system that will overcome the shortcomings of the prior art devices.

A second object is to provide a railroad clip removal system for efficiently removing a fastening clip from a receiver bracket of a crosstie.

Another object is to provide a railroad clip removal system that does not require significant manual labor.

An additional object is to provide a railroad clip removal system that decreases the amount of time required to remove a fastening clip from a receiver bracket.

A further object is to provide a railroad clip removal system that does not require more than one person to remove a fastening clip.

Another object is to provide a railroad clip removal system that ensures proper removal of the fastening clip from a receiver bracket.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 12*a* is a top view of the fastening clip positioned away from the receiver bracket.

FIG. 12*b* is a top view of the fastening clip partially extended into the receiver bracket with the prongs compressed inwardly within the tapered slot of the receiver bracket.

FIG. 12*c* is a top view of the fastening clip fully extended into the receiver bracket with the prongs at their normal state and catchably retained upon the receiver bracket.

DESCRIPTION OF THE PREFERRED EMBODIMENT

Figure 1:
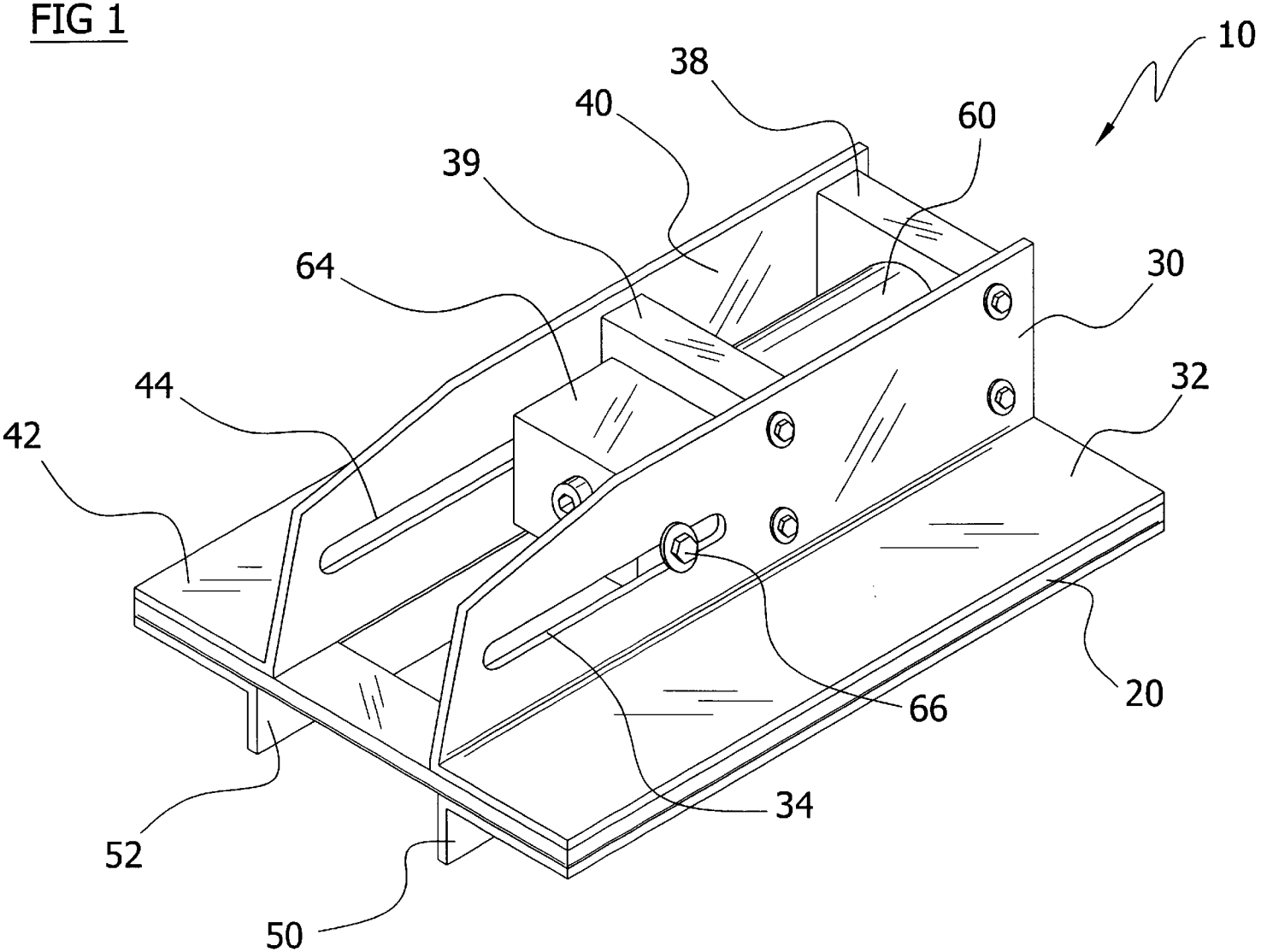
FIG. 1 is an upper perspective view of the present invention.

Turning now descriptively to the drawings, in which similar reference characters denote similar elements throughout the several views, FIGS. 1 through 12*c* illustrate a railroad clip removal system 10, which comprises a frame structure having a center cutout and a pair of opposing slots, an actuator 60, a pair of engaging arms 70 pivotally attached to the actuator 60 and slidably positioned within the opposing slots. The engaging arms 70 have a catch portion 77 that engages the fastening slip while the engaging arms 70 simultaneously compress the prongs of the fastening clip 2 thereby removing the fastening clip 2 from the receiver bracket of a crosstie 19. As shown in FIGS. 12*a*–12*c*, the fastening clip 2 typically includes a rear slot 9 that separates the prongs 4, 6.

Figure 8:
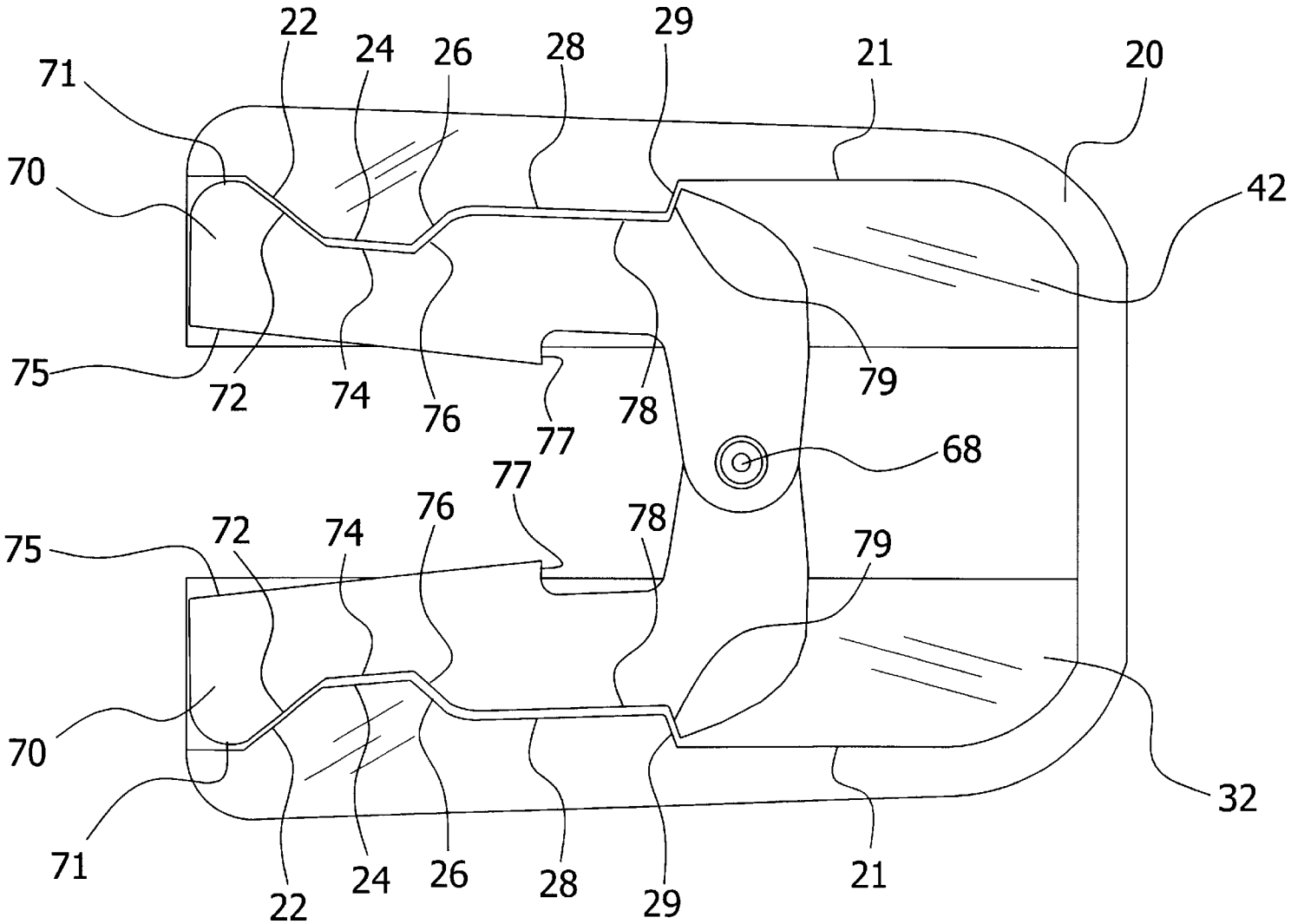
FIG. 8 is a bottom view of the present invention with the base plates removed.
Figure 9:
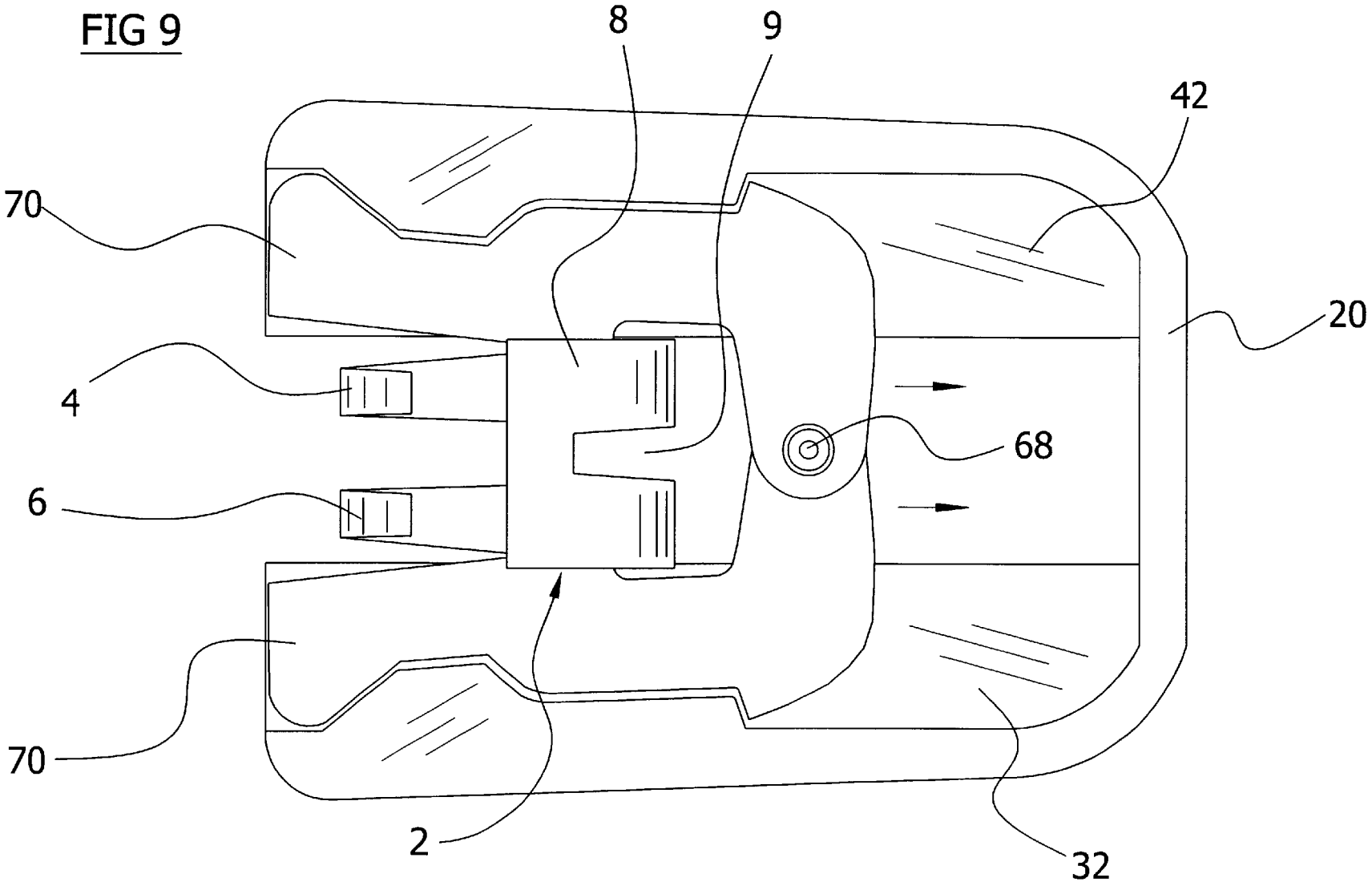
FIG. 9 is a bottom view of the present invention positioned about a fastening clip at Stage 1.

As shown in FIGS. 1 through 5 of the drawings, the frame structure is basically comprised of a main member 20 having a cutout extending substantially within for defining the structure of the opposing slots. The cutout within the main member 20 preferably extends from a rear end of the main member 20 toward the opposing front end as best shown in FIG. 8 of the drawings. More particularly, the cutout is comprised of a front section 21, a pair of opposing first sections 22, a pair of opposing second sections 24, a pair of opposing third sections 26, a pair of opposing fourth sections 28, and a pair of opposing fifth sections 29 as shown in FIG. 8 of the drawings.

Figure 10:
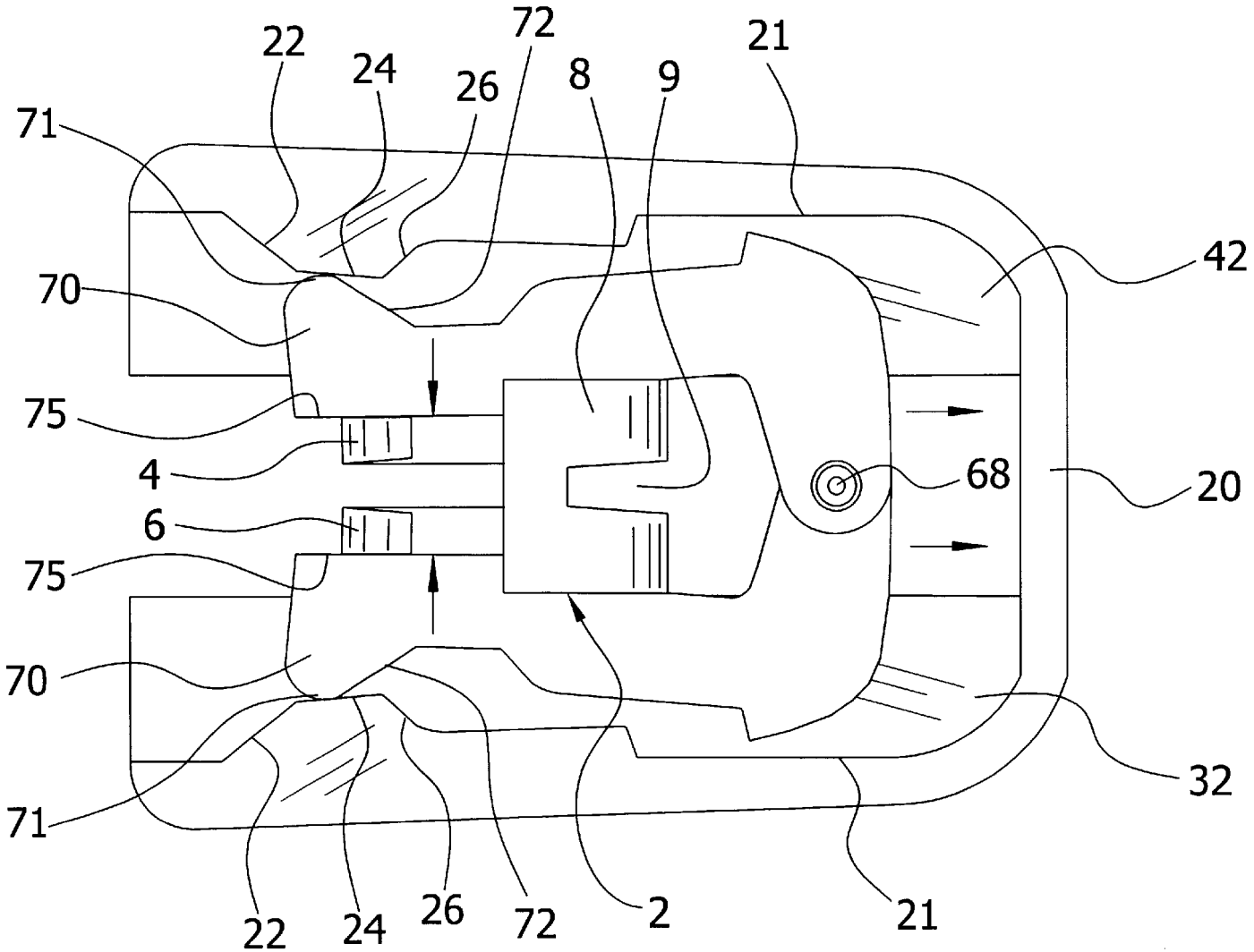
FIG. 10 is a bottom view of the present invention in Stage 2 wherein the fastening clip is simultaneously compressed and slid from the receiver bracket.

As further shown in FIG. 8 of the drawings, the opposing first sections 22 are tapered inwardly to guide the engaging arms 70 inwardly as they are forced forwardly. The opposing second sections 24 extend from the respective first sections 22 in a substantially parallel manner for maintaining the desire compression force upon the fastening clip 2 while the fastening clip 2 is forced outwardly from the tapered slot of the receiver bracket as shown in FIG. 10 of the drawings.

Figure 11:
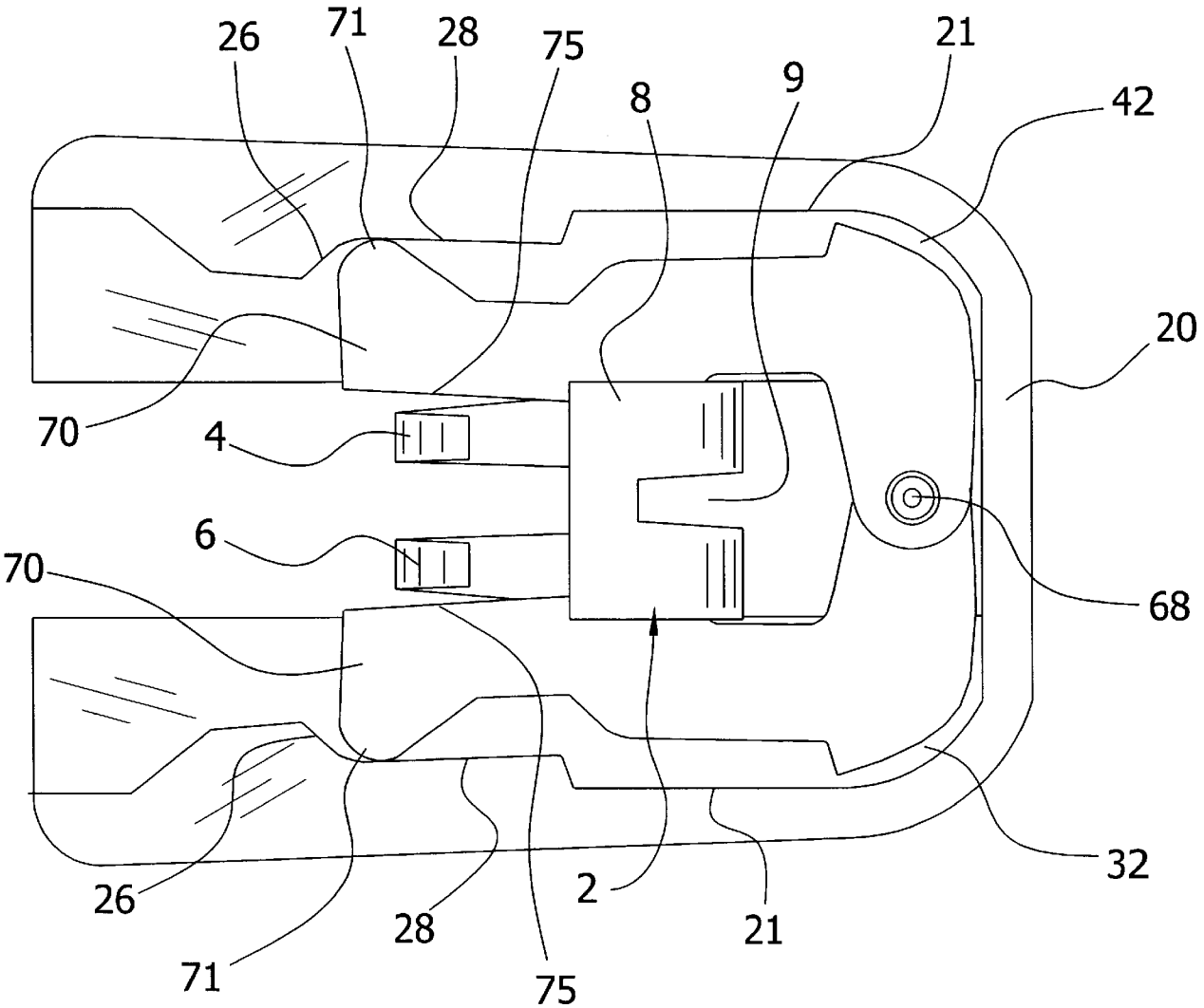
FIG. 11 is a bottom view of the present invention in Stage 3 wherein the fastening clip is no longer compressed and fully removed from the receiver bracket.

As further shown in FIG. 11 of the drawings, the opposing third sections 26 are tapered outwardly to guide the engaging arms 70 outwardly as they are forced forwardly thereby releasing the compression force from the fastening clip 2. FIG. 11 further illustrates the opposing fourth sections 28 that are substantially parallel to one another thereby allowing the engaging arms 70 to extend forwardly in an open position until the fastening clip 2 is removed from the apparatus. The front section 21 of the main member 20 provides for adequate room for the pivoting portion of the engaging arms 70 to operate within.

The first frame 30 and the second frame 40 are attached to opposing upper portions of the main member 20 as shown in FIGS. 1, 3, 4 and 8 of the drawings. The first frame 30 and the second frame 40 each include a first member 32 and a second member 42 respectively that are juxtaposed with the upper surface of the main member 20 to create the upper ceiling of the opposing slots as shown in FIG. 8 of the drawings. A plurality of cross members 38, 39 are preferably attached between the first frame 30 and the second frame 40 for maintaining the strength and integrity of the frame structure. It can be appreciated that various other frame structures may be utilized to construct the frame of the present invention and the drawings should not limited the scope of protection offered.

A first base plate 54 and a second base plate 56 are attached to the lower surface of the main member 20 opposite of the first member 32 and the second member 42 respectively to form the opposing slots between thereof that slidably receive the engaging arms 70. A first lower member 50 and a second lower member 52 extend downwardly from the first base plate 54 and the second base plate 56 respectively to form a guide for the fastening clip 2 during removal of the fastening clip 2 from the receiver bracket.

Figure 2:
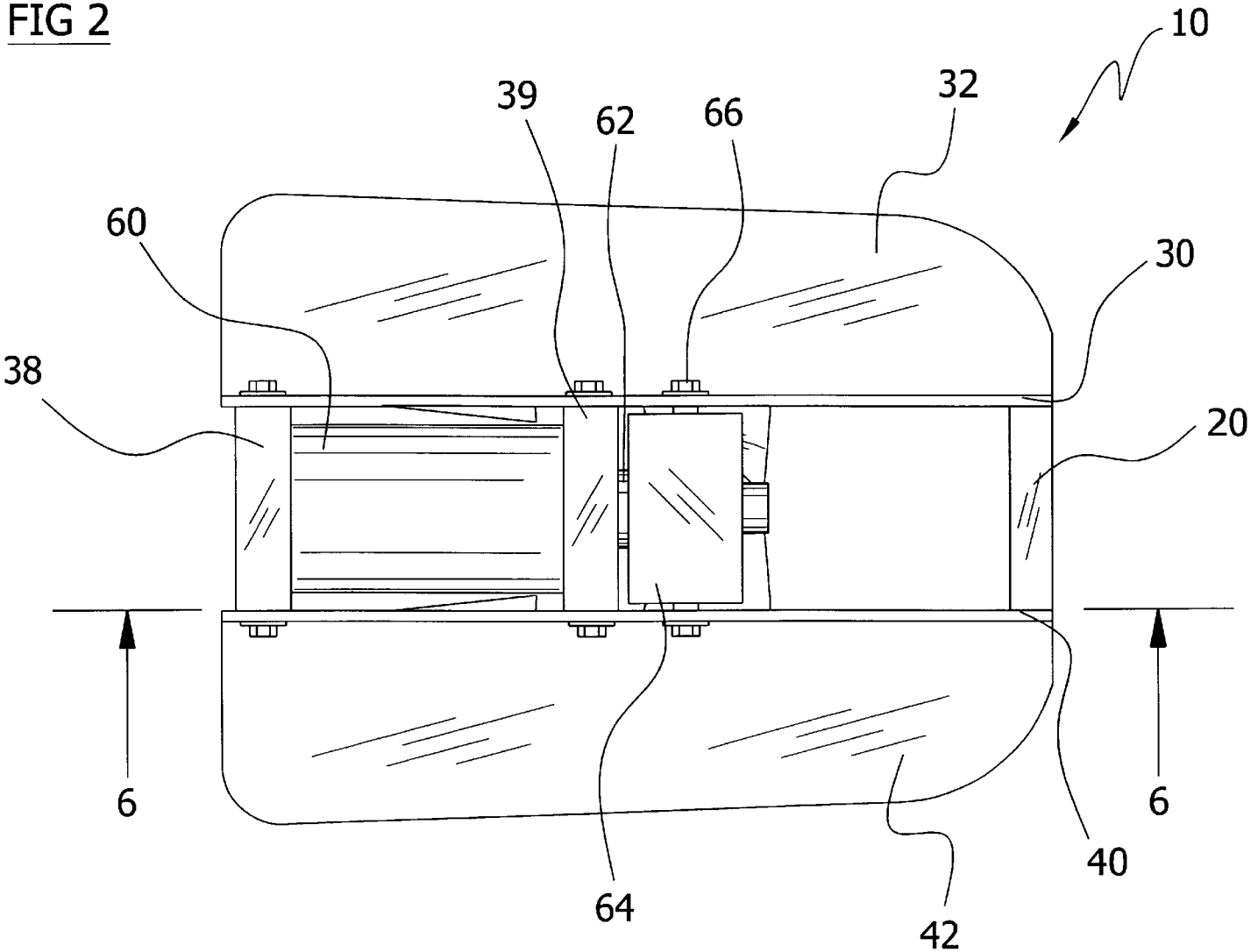
FIG. 2 is a top view of the present invention.
Figure 4:
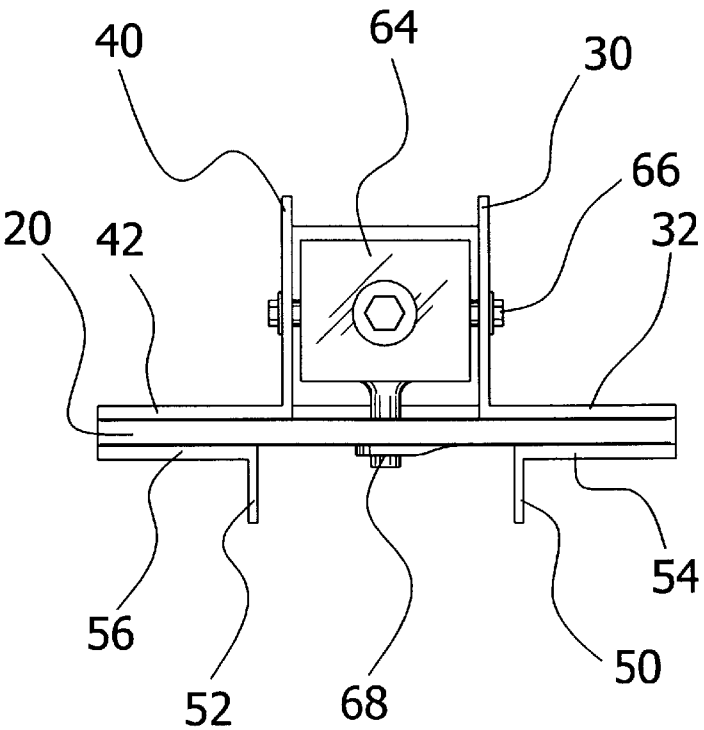
FIG. 4 is a front view of the present invention.
Figure 3:
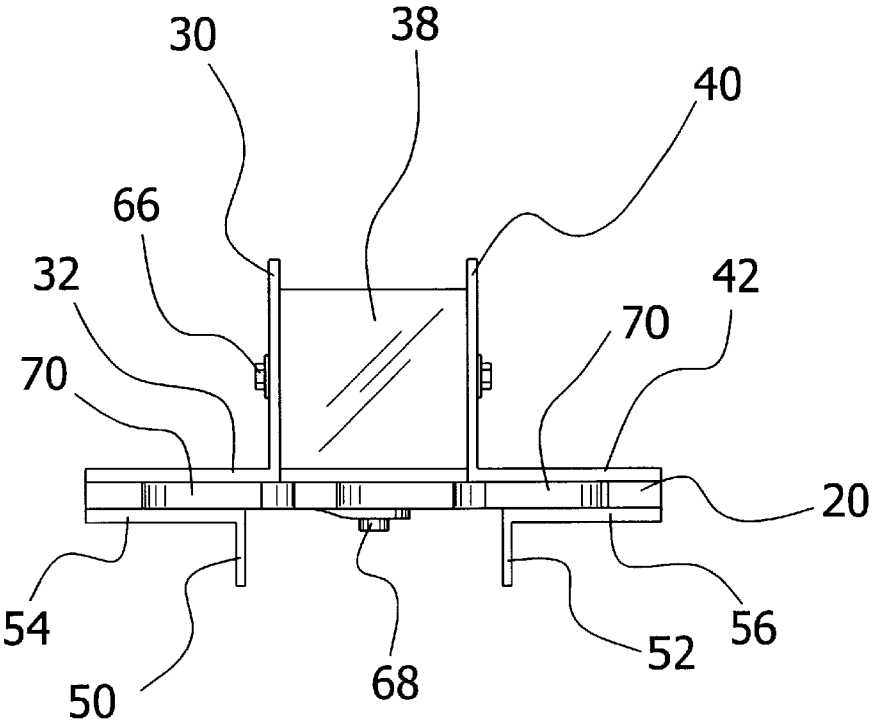
FIG. 3 is a rear view of the present invention.
Figure 5:
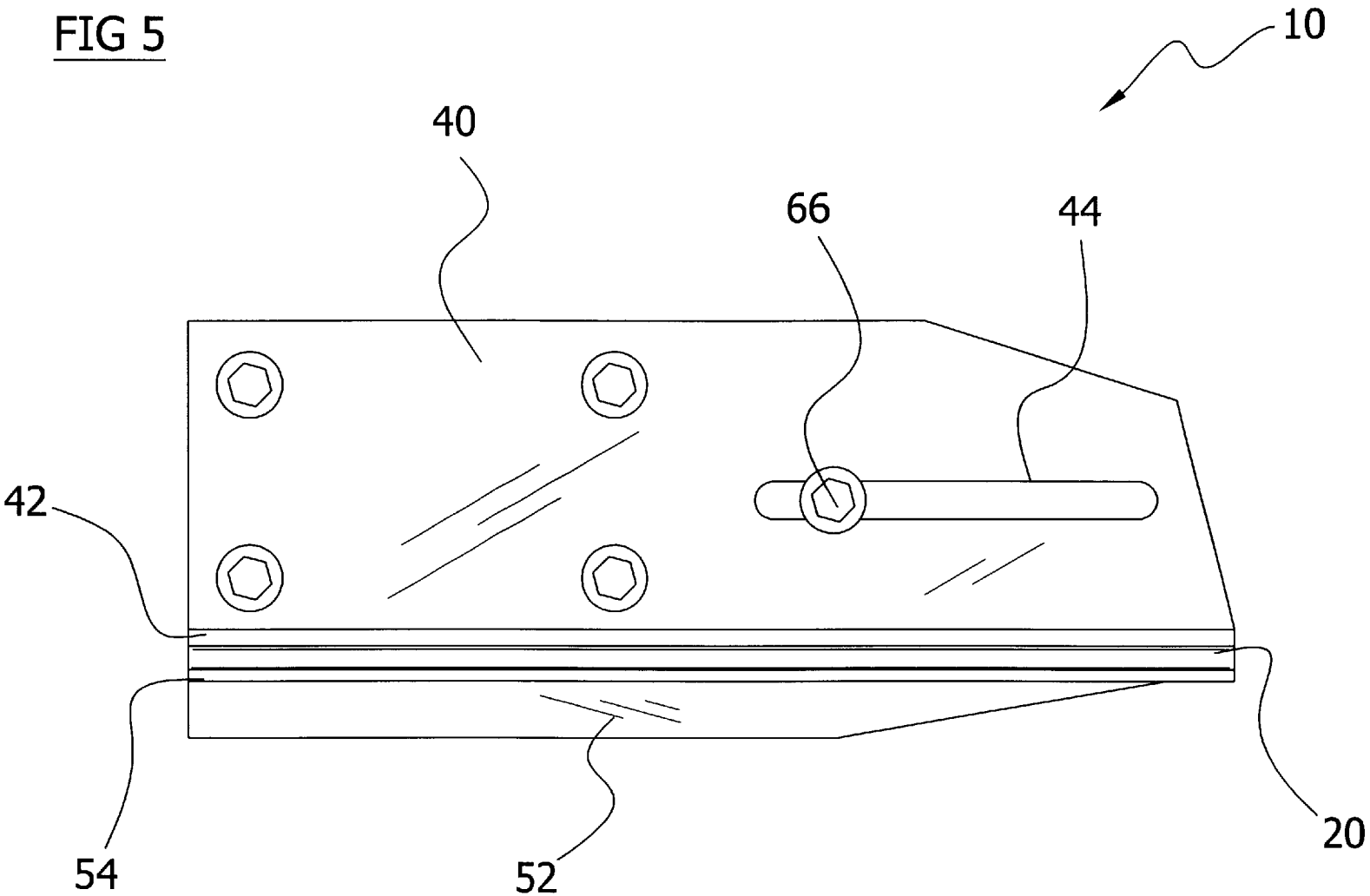
FIG. 5 is a side view of the present invention.
Figure 6:
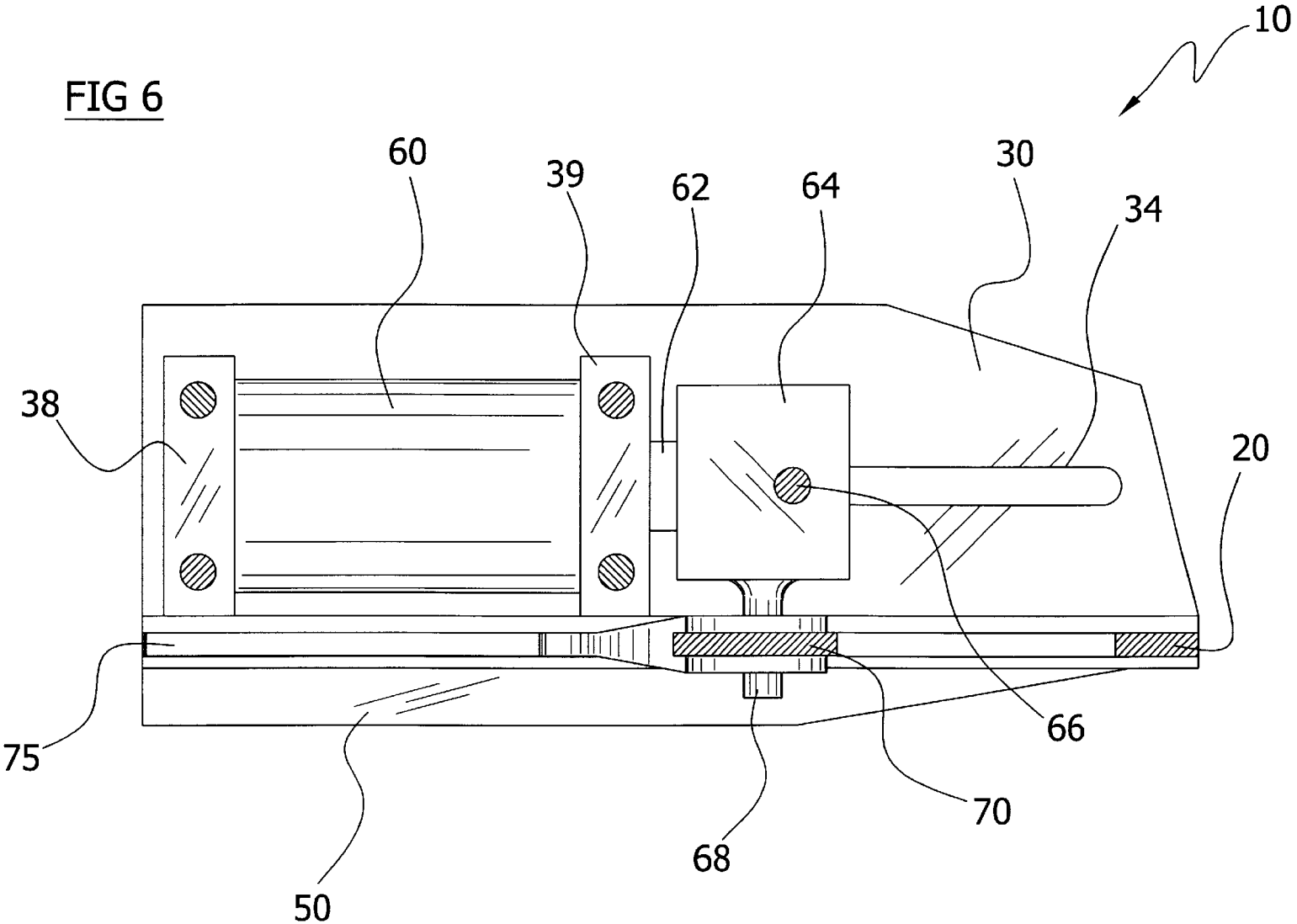
FIG. 6 is a cross sectional view taken along line 6—6 of FIG. 2.
Figure 7:
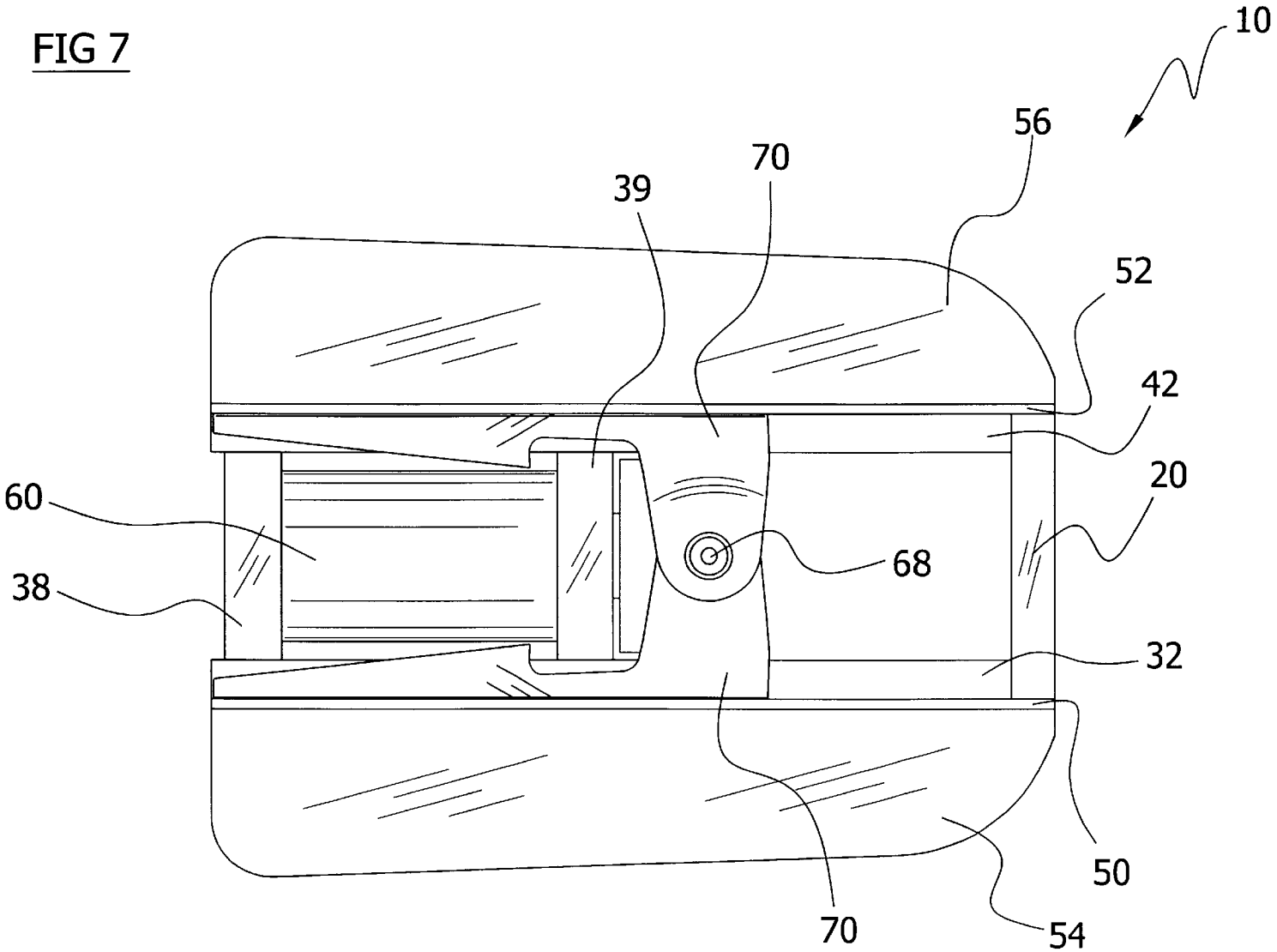
FIG. 7 is a bottom view of the present invention.

As shown in FIGS. 8, 9, 10 and 11 of the drawings, the engaging arms 70 have an outer perimeter similar in shape to the inner perimeter of the main member 20 defining the opposing slot structures. The engaging arms 70 further each have an inner edge 75 that is substantially straight for engaging and compressing the prongs 4, 6 of the fastening clip 2. The engaging arms 70 are pivotally attached to a lower pin 68 that is attached in a vertical manner to a coupler 64. The actuator 60 is attached between the first frame 30 and the second frame 40 as best shown in FIG. 2 of the drawings. The shaft 62 of the actuator 60 is attached to the coupler 64 to transfer the force from the actuator 60 to the engaging arms 70. A pair of upper pins 66 extending substantially horizontally from the coupler 64 are slidably received within a first slot 34 and a second slot 44 within the first frame 30 and the second frame 40 respectively as shown in FIG. 1 of the drawings. The upper pins 66 provide guidance to the actuator 60 and the engaging arms 70 to ensure proper alignment and transfer of force from the actuator 60 to the engaging arms 70. The actuator 60 may be comprised of a hydraulic cylinder, electrical actuating device, air pressure actuating device or similar structure commonly utilized for actuators 60. The actuator 60 may be controlled via any conventional control means commonly utilized for the type of actuator 60 utilized. For example, a valve assembly would be utilized for a hydraulic actuator 60.

The engaging arms 70 each have end portions 71 opposite of the pivot location with the lower pin 68 as shown in FIG. 8 of the drawings. The end portions 71 are preferably rounded to assist in the guiding of the engaging arms 70 within the opposing slots adjacent the inner portion of the main member 20. The end portions 71 may have various other shapes and structures than that illustrated in the drawings.

The engaging arms 70 each have a first portion 72 having a corresponding shape with the first section 22 of the main member 20 as shown in FIG. 8 of the drawings. The engaging arms 70 each have a second portion 74 having a corresponding shape with the second section 24 of the main member 20 as shown in FIG. 8 of the drawings. The engaging arms 70 each have a third portion 76 having a corresponding shape with the third section 26 of the main member 20 as shown in FIG. 8 of the drawings. The engaging arms 70 each have a fourth portion 78 having a corresponding shape with the fourth section 28 of the main member 20 as shown in FIG. 8 of the drawings. The engaging arms 70 also each have a fifth portion 79 having a corresponding shape with the fifth section 29 of the main member 20 as shown in FIG. 8 of the drawings. In addition, the engaging arms 70 each have a catch portion 77 that extends inwardly to engage the looped portion of the fastening clip 2 when compressed upon the fastening clip 2.

In use, the user positions the clip removal system 10 with the engaging arms 70 within the open position about the fastening clip 2 as shown in FIG. 8 of the drawings. The user then operates the actuator 60 to extend the shaft 62 forwardly thereby causing the engaging arms 70 to move forwardly within the opposing slots. The first portions 72 of the engaging members slidably engage the first sections 22 of the main member 20 thereby causing the rear portions of the engaging arms 70 to pivot inwardly as the engaging arms 70 are moved forwardly. As the engaging arms 70 are pivoted inwardly, the inner edge 75 of the respective engaging arms 70 engages the prongs 4, 6 of the fastening clip 2 thereby compressing the prongs 4, 6 to allow removal from the tapered slot of the receiver bracket. As shown in FIG. 10 of the drawings, the end portion engages and slides upon the second sections 24 of the main member 20 in a substantially straight manner. As the engaging arms 70 are moved forwardly with the end portions 71 engaging the second sections 24, the catch portion 77 of each of the engaging members catch upon the inner portion of the prongs 4, 6 directly above the closed lower portion 8 of the fastening clip 2. After the catch portion 77 of the engaging member engage the fastening clip 2, the fastening clip 2 is then forced forwardly out of the receiver bracket away from the rail 12, the lower portion 14 of the rail 12, and the pad member 16. The actuator 60 continues moving the engaging arms 70 forwardly with the fastening clip 2 catchably secured within. As the end portions 71 of the engaging arms 70 engages the third sections 26 of the main member 20, the engaging arms 70 are allowed to pivot outwardly thereby releasing the compression force upon the prongs 4, 6 of the fastening clip 2. The engaging arms 70 are pivoted outwardly until no compression force is applied to the prongs 4, 6 of the fastening clip 2. The end portions 71 of the engaging members then slide forwardly upon the fourth sections 28 of the main member 20 in a straight manner until the fastener clip is removed from between the engaging arms 70. The actuator 60 is then controlled to contract the shaft 62 thereby forcing the engaging arms 70 rearwardly within the opposing slots of the frame structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A railroad clip removal system for removing a fastening clip having a pair of prongs from within a receiver bracket secured to a crosstie, comprising:

a frame having a rear cutout and a pair of opposing guide slots adjacent said rear cutout;

an actuator secured within said frame; and a pair of engaging arms having a front end and a rear end slidably positioned within said opposing guide slots and mechanically connected to said actuator, wherein said front end of said engaging arms are pivotally attached to one another, wherein said engaging arms each include an inner edge for engaging said prongs of said fastening clip, an outer edge slidably adjacent an inner wall of said guide slots, and a catch portion extending inwardly for engaging said fastening clip during a forward movement of said engaging arms;

wherein said inner wall of said guide slots each have a first section, a second section, a third section and a fourth section, wherein said first section is tapered inwardly and wherein said second section is substantially straight extending from said first section.

2. The railroad clip removal system of claim 1, wherein said third section extends from said second section tapering outwardly.

3. The railroad clip removal system of claim 2, wherein said fourth section extends from said third section in a straight manner.

4. The railroad clip removal system of claim 3, wherein said second section and said fourth section are substantially parallel to a line of movement of said actuator.

5. The railroad clip removal system of claim 1, wherein said outer edge corresponds in shape to said inner wall of said guide slots.

6. The railroad clip removal system of claim 5, wherein said outer edge of said engaging arms is comprised of a first portion, a second portion, a third portion and a fourth portion.

7. The railroad clip removal system of claim 6, wherein said first portion is tapered inwardly.

8. The railroad clip removal system of claim 7, wherein said second portion is substantially straight.

9. The railroad clip removal system of claim 8, wherein said third portion is tapered outwardly.

10. The railroad clip removal system of claim 9, wherein said fourth portion is substantially straight.

11. The railroad clip removal system of claim 5, wherein said outer edge of said engaging arms is comprised of a first portion, a second portion, a third portion, a fourth portion, and an end portion adjacent said first portion.

12. The railroad clip removal system of claim 11, wherein said first portion is tapered inwardly.

13. The railroad clip removal system of claim 12, wherein said second portion is substantially straight.

14. The railroad clip removal system of claim 13, wherein said third portion is tapered outwardly.

15. The railroad clip removal system of claim 14, wherein said fourth portion is substantially straight.

16. The railroad clip removal system of claim 15, wherein said end portion is comprised of a curved structure.

17. A railroad clip removal system comprising:

a frame having a rear cutout and a pair of opposing guide slots adjacent said rear cutout;

an actuator secured within said frame; and a pair of engaging arms having a front end and a rear end slidably positioned within said opposing guide slots and mechanically connected to said actuator, wherein said front end of said engaging arms are pivotally attached to one another, wherein said engaging arms each include an inner edge for engaging said prongs of said fastening clip, an outer edge slidably adjacent an inner wall of said guide slots, and a catch portion extending inwardly for engaging said fastening clip during a forward movement of said engaging arms;

wherein said frame is comprised of a main member with said rear cutout extending within, a pair of upper frames attached to an upper surface of said main member, and a pair of lower frames attached to a lower surface of said main member thereby defining said guide slots between thereof;

wherein said inner wall of said guide slots each have a first section, a second section, a third section and a fourth section, wherein said first section is tapered inwardly and wherein said second section is substantially straight extending from said first section.

18. The railroad clip removal system of claim 17, wherein said third section extends from said second section tapering outwardly.

19. A railroad clip removal system for removing a fastening clip having a pair of prongs from within a receiver bracket secured to a crosstie, comprising:

a frame having a rear cutout and a pair of opposing guide slots adjacent said rear cutout;

an actuator secured within said frame; and a pair of engaging arms having a front end and a rear end slidably positioned within said opposing guide slots and mechanically connected to said actuator, wherein said front end of said engaging arms are pivotally attached to one another, wherein said engaging arms each include an inner edge for engaging said prongs of said fastening clip, an outer edge slidably adjacent an inner wall of said guide slots, and a catch portion extending inwardly for engaging said fastening clip during a forward movement of said engaging arms;

wherein said inner wall of said guide slots each have a first section and a second section, wherein said first section is tapered inwardly and wherein said second section is substantially straight extending from said first section.

* * * * *